US008813809B2

(12) United States Patent
Braggs

(10) Patent No.: US 8,813,809 B2
(45) Date of Patent: Aug. 26, 2014

(54) ELECTRICAL HEATING WINDOW CURTAINS

(76) Inventor: Herbert Braggs, New Orleans, LA (US)

( * ) Notice: Subject to any disclaimer, the term of this patent is extended or adjusted under 35 U.S.C. 154(b) by 1 day.

(21) Appl. No.: 12/806,953

(22) Filed: Feb. 8, 2011

(65) Prior Publication Data

US 2011/0203743 A1 Aug. 25, 2011

Related U.S. Application Data

(60) Provisional application No. 61/307,852, filed on Feb. 25, 2010.

(51) Int. Cl.
*A47H 1/00* (2006.01)

(52) U.S. Cl.
USPC ..... 160/330

(58) Field of Classification Search
USPC ..... 160/330; 219/201, 547, 529
See application file for complete search history.

(56) References Cited

U.S. PATENT DOCUMENTS

| | | | | | |
|---|---|---|---|---|---|
| 2,469,466 | A * | 5/1949 | Herrington | ..... | 219/201 |
| 2,495,414 | A * | 1/1950 | Herrington | ..... | 219/201 |
| 2,660,659 | A * | 11/1953 | Sarno | ..... | 219/201 |
| 3,265,864 | A * | 8/1966 | Levinson | ..... | 219/545 |
| 3,390,251 | A * | 6/1968 | Lowenfish | ..... | 219/213 |
| 4,664,169 | A * | 5/1987 | Osaka et al. | ..... | 160/107 |
| 4,951,730 | A * | 8/1990 | Hsu | ..... | 160/310 |
| 5,025,848 | A * | 6/1991 | Prochaska | ..... | 160/368.1 |
| 6,403,935 | B2 * | 6/2002 | Kochman et al. | ..... | 219/545 |
| 7,195,051 | B2 * | 3/2007 | Nien | ..... | 160/243 |
| 2008/0245786 | A1 * | 10/2008 | Sharma | ..... | 219/529 |
| 2011/0203743 | A1 * | 8/2011 | Braggs | ..... | 160/127 |

* cited by examiner

*Primary Examiner* — Blair M. Johnson
(74) *Attorney, Agent, or Firm* — Maier & Maier, PLLC

(57) ABSTRACT

An electrically heated window curtain of fire resistant material to heat up the draft flow of cold air that leaks through single pane glass windows with low voltage heating wires embedded in the fire resistant material, a power source, a thermostat, a battery pack, and a charger. Also included is a curtain rod and gripping strips on the curtain to hold the curtain in a rolled up position when not in use.

5 Claims, 6 Drawing Sheets

ELECTRICAL HEATING WINDOW CURTAINS

This application claims priority from U.S. Provisional application Ser. No. 61/307,852, ("the '852 application") filed Feb. 25, 2010. The '852 application is incorporated herein by reference.

BACKGROUND OF THE INVENTION

This invention relates to electrically heated window curtains for home or building use, designed to heat up the draft flow of cold air that leaks through single pane glass windows.

SUMMARY OF THE INVENTION

The inventive electrical heating window curtain is designed and constructed to warm the draft flow of air (cold air) that escapes into the house and through single pane glass windows by being fabricated with internal heating elements powered by an electrical cord connection; or it can be connected directly to a home electrical source. The heating elements will be low voltage thus avoiding 120 volt wiring I the Curtains. A self-regulating hearing cable will prevent overheating. The thermostat will sense the ambient temperature near the window inside surface. A battery backup will provide a limited time of operation if the normal power is lost. The purpose is to save money on electrical bills and to help in saving lives when the electrical power is interrupted.

It is an object of this invention to provide an electrically heated window curtain of fire resistant material having an interior side, an exterior side facing the window, a top, a bottom, a right side and a left side, with low voltage heating wires embedded in the fire resistant material further comprising a power source, a thermostat, a battery pack, and a charger.

It is a further object of this invention to provide an electrically heated window curtain further comprising a curtain rod having a right end and a left end, with the top of the window curtain affixed to the curtain rod, and having a power supply box on one of the curtain rod to receive the thermostat. It is further intended that there be gripping strips affixed to the exterior side for securing the curtain in a rolled-up condition.

DETAILED DESCRIPTION OF THE INVENTION

Figure 1:
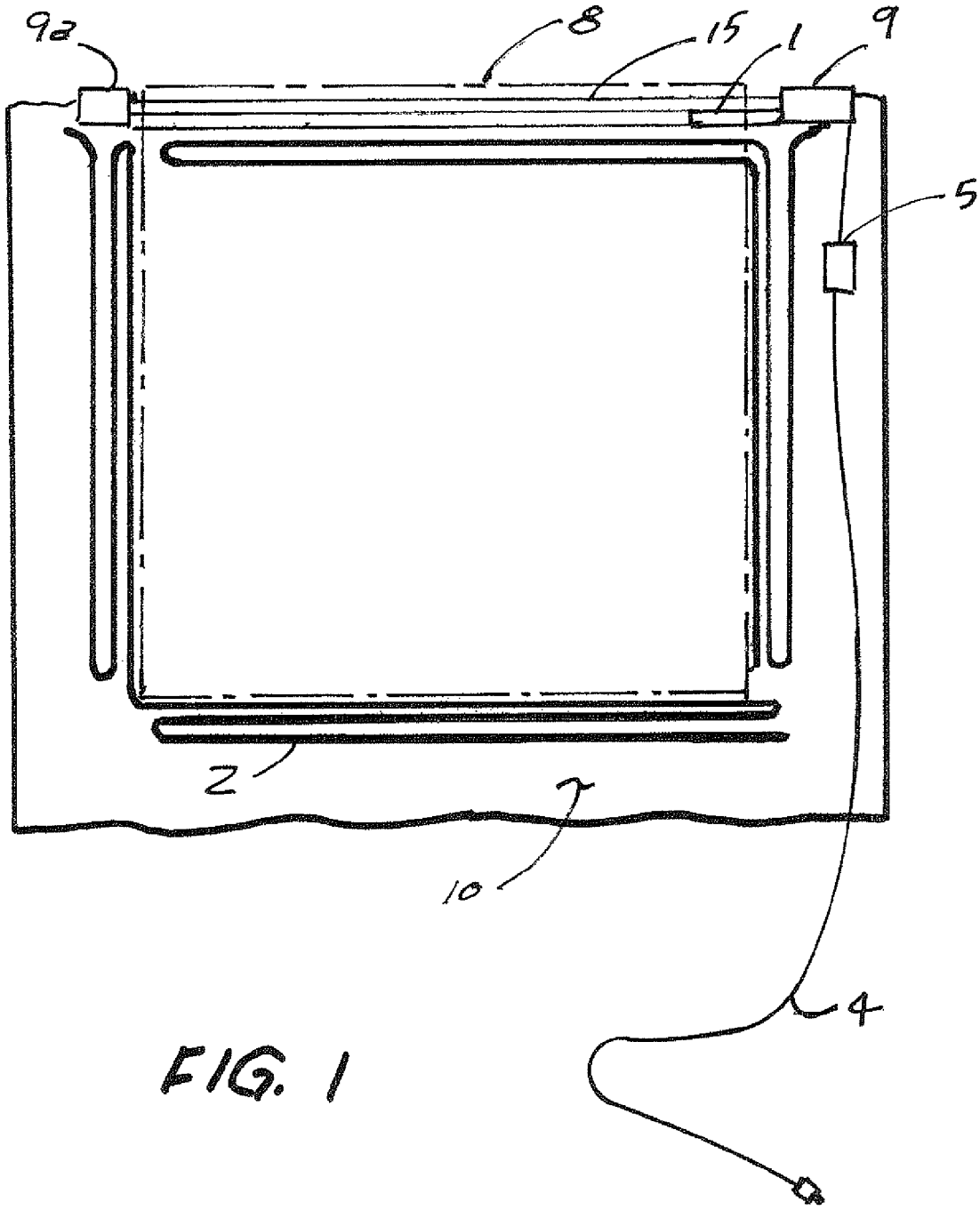
FIG. 1 is the elevation view showing the window frame and an 8 inch extension of the inventive electrical heating window curtain. The distance between the window glass and the face of the inventive electrical heating window curtain is also shown.

In FIG. 1, an elevation view of the inventive electrical heating window curtain 10 is shown in place over a window frame 8 with a nominal 8" extension to the right and left side of the window 8. A curtain rod 15 is shown with a right power supply box 9 and a left power supply box 9*a*. A battery pack

1 is shown. This battery pack 1 would normally be a 12V 7Ah NICad battery. Also shown are carbon fiber heating wires 2 embedded in the curtain material. Also shown is low voltage insulated wire 4 and a 12 volt charger 5 for the battery pack 1. It is intended that the charger 5 be fitted with a thermostat temperature sensor 6 as shown in FIG. 2.

Figure 1A:
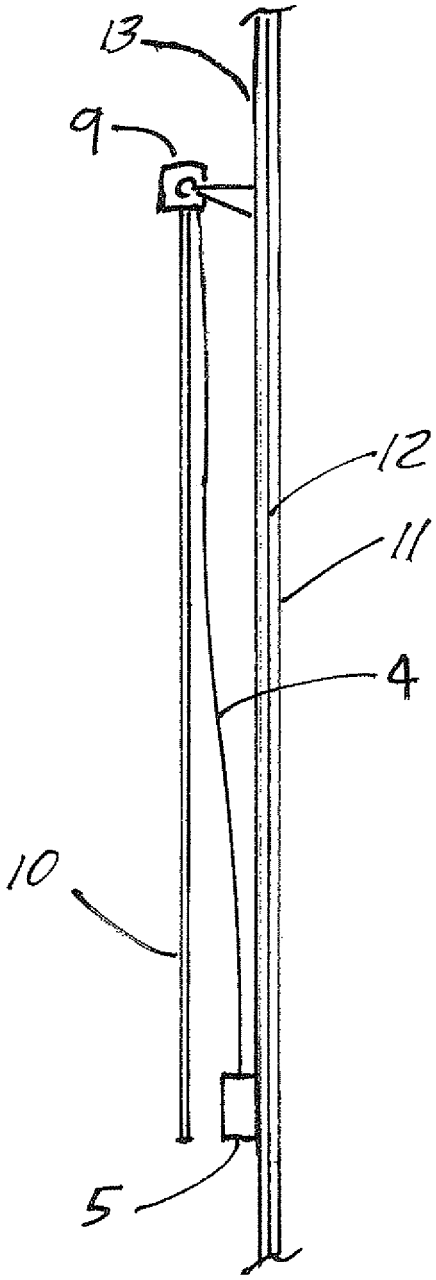
FIG. 1A is a side view of the elevation view shown in FIG. 1

FIG. 1A shows a side view of the elevation shown in FIG. 1 and shows the curtain 10 mounted on an interior window frame 13. Also shown is the exterior window frame 11 and the face 12 of the window glass, along with the right power supply box 9.

Figure 2:
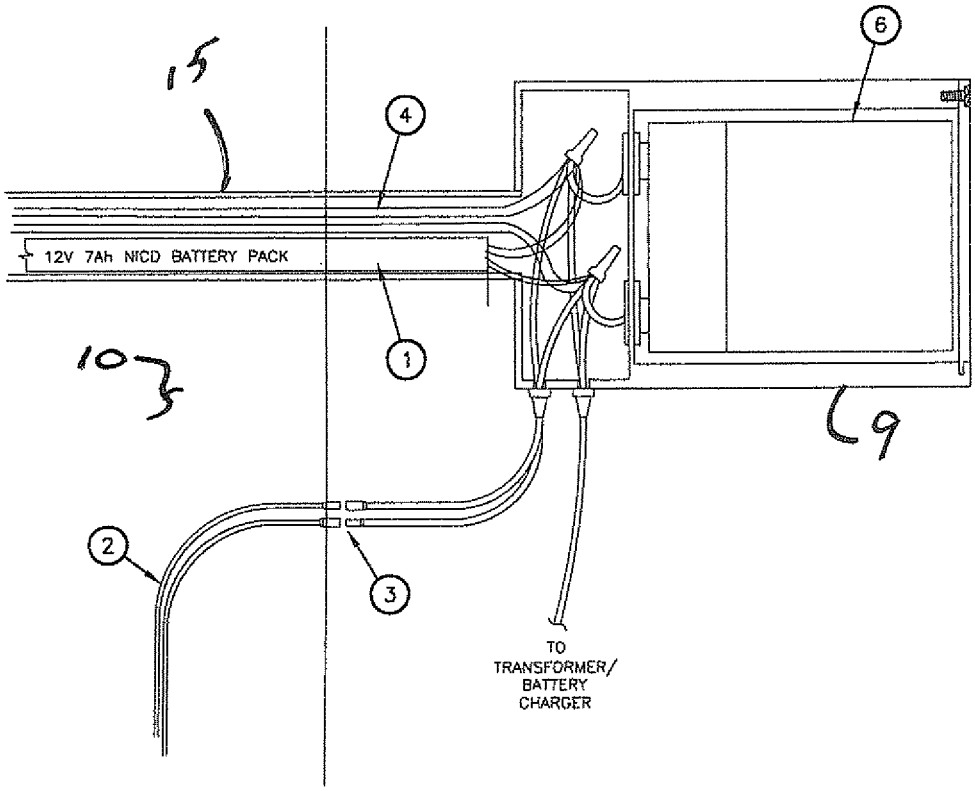
FIG. 2 is a detail of the curtain rod with the power supply boxes which contain the thermostat and the backup battery.
Figure 2:
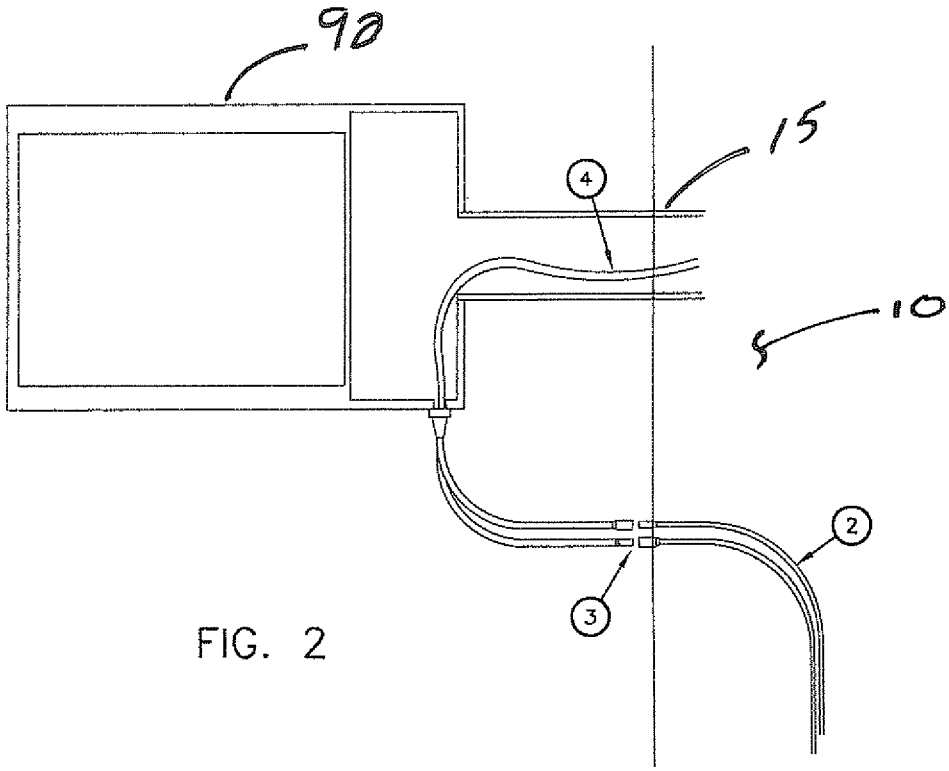

In FIG. 2, both ends of the curtain rod 15 are shown with the right and left power supply boxes 9 and 9*a* which contain the thermostat 6 and the backup battery pack 1. Also shown in FIG. 2 are the carbon fiber heating wires 2, the low voltage insulated wire 4 and quick disconnects 3 for the low voltage insulated wire 4.

Figure 3:
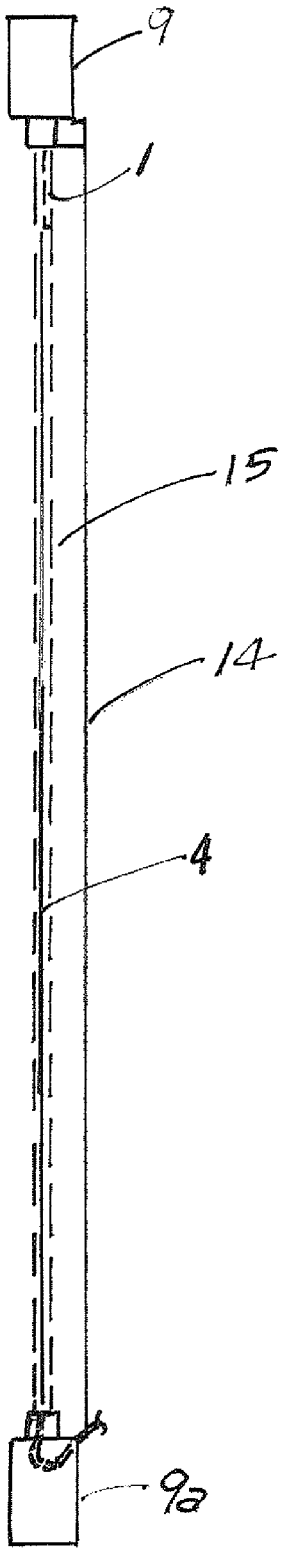
FIG. 3 is enlarged view of the curtain rod assembly.

FIG. 3 depicts an enlarged view of the curtain rod assembly 14 showing a roller assembly on the curtain rod 15 with right and left power supply boxes 9 and 9*a*.

Figure 4:
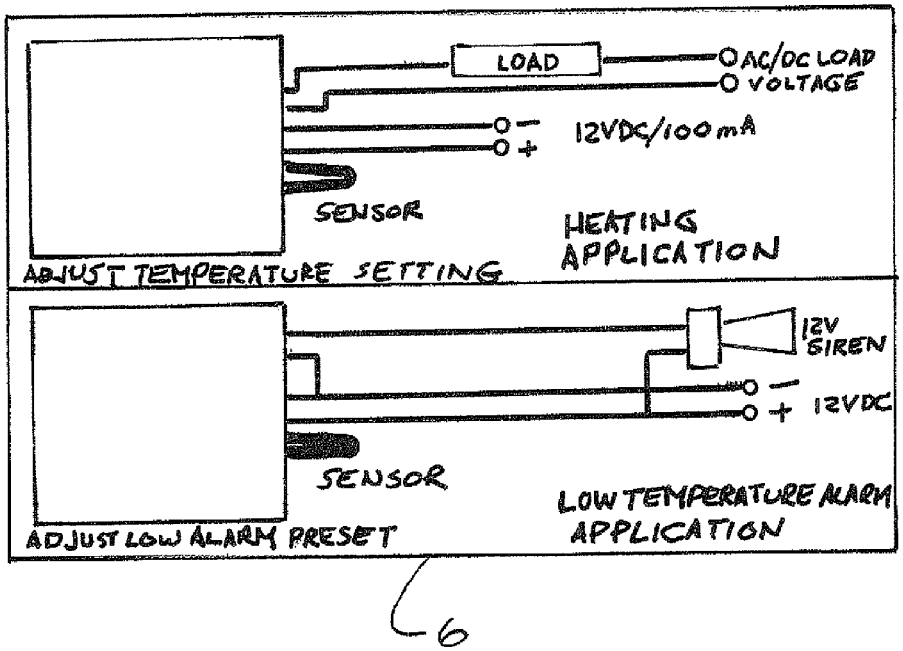
FIG. 4 is a detail view of the thermostat assembly.

FIG. 4 is a depiction of the thermostat assembly and circuit.

Figure 5:
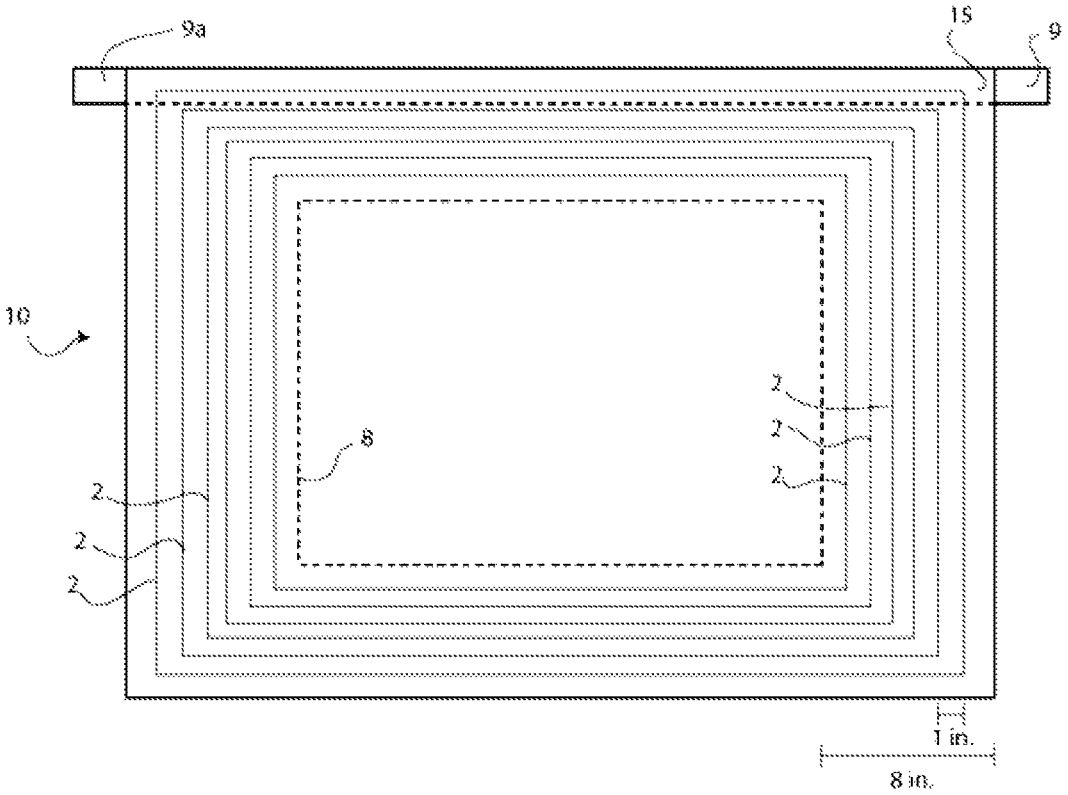
FIG. 5 is another elevation view of a heating curtain with an 8 inch extension around a window.

FIG. 5 shows typical placement of Velcro® or similar adhesive strips 7 on the inventive curtain 10 for securing the curtain 10 in both a fully rolled-up position or a partially rolled-up position.

The figures generally depict the inventive curtain in place over a 36" by 36" window 8. It is calculated that in this configuration the total wattage consumed is 8 watts at 12 volts, 0.66 amps. The carbon fiber heating wires 2 will be located at the exterior of the curtain. The curtain will have an 8 inch over hang on both sides and bottom to retain the heated air. The 12 volt DC charger 5 shall have Red-Green LED charging indicator lights and an automatic short circuit protection. A self-regulating carbon fiber heating wire 2 will prevent overheating. The wires 2 will increase heat output as the surrounding media, (air) cools and conversely decrease heat output as the surrounding media warms. The embedded carbon fiber low voltage heating wires 2 will have quick disconnect connectors 3 to connect the heating leads to the low voltage power supply. A thermostat 6 will sense the ambient temperature on the window inside surface and switch on the power to energize the heating wires 2 when the ambient temperature on the inside of the window glass surface drops down to 60 degrees Fahrenheit. The thermostat 6 will turn off the heating curtains when the temperature between the curtains and the window surface reaches 72 degrees Fahrenheit. A 12 volt 7Ah NiCad battery backup will provide 12 hours of operating if the normal power is lost.

The inventive electrical heating window curtain and the curtains rod will be shipped as an assembly. The rod assembly can be mounted over the window using a wall mounting kit included with the rod assembly. The carbon fiber heating wires 2 will connect to the power leads in the curtain rod with quick disconnect connectors 3. The battery pack 1 will be housed inside of the rod assembly and the thermostat 6 will be housed in an enclosure located at the left end of the curtain rod. The power wiring for right hand curtains will be routed through the rod and be enclosed in a connection box located on the right hand side of the rod.

The inventive electrical heating window curtain and the curtain rod will be assembled as one, meaning that the inventive curtains will be built onto the curtain rod and only the curtain rod will need to be mounted onto the wall. The curtain rod will be built onto the curtains and the curtain rod will extend no less than three and one half inches from the wall. The curtain material (outer layer) will be made of Teflon. There will be a (inner layer) of fabric to also give insulation protection with the use of the (six) carbon fiber heating wires as used with the inventive electrical heating window curtain. The insulated curtains will give the protection for heat resistance, radiation, and will come with a laminated fiber coating to shield the heat (one way) for the (six) heating wire elements heating flow purpose. Aluminum foil coated insulated fabric will be used to cover only the eight inches of space for the (six) heating wire elements and the insulation will be placed behind the electrical heating wire elements for insulating purpose. The aluminum insulation will be sewed onto the inside of the Teflon Curtains and will give the extra protection to Electrical heating window curtains. The six heating elements and the control box will be sealed and mounted onto the insulated fabric. One yard and a half of each type of the Teflon material and the Aluminum insulation material will be used for this embodiment of the inventive electrical heating window curtain. The home window measurement is 36 inches by 36 inches; which equal to three feet square and a one yard of space. Meaning a yard and a half of the Teflon and a yard and a half of the Aluminum insulated fabric material will be needed for this example of the inventive electrical heating window curtain.

The inventive electrical heating window curtain will consist of three layers of materials, with the carbon fiber heating wires 2 will be located between two layers of fire resistant materials and the interior side facing into the room will be a fabric material to provide insulation and allow the product to be manufactured with various choices of interior fabrics. The inventive electrical heating window curtain will be able to be rolled up and secured with a Velcro® strap or similar gripping strip when the inventive electrical heating window curtain is not in operation. Starting at the bottom, the inventive curtain can be rolled all the way up to the top and wrapped with Velcro® clad strips around the curtain to keep it up. At night, it is simple to undo the Velcro® strips to let the curtains down.

The inventive electrical heating window curtain will work off a power source of 120 voltage 8 watts, 0.0666 amps; with the carbon fiber heating wires being 1/16 in diameter. The fuse size being amps 1.25 vac. (v) 125 nominal melting 0.2T (A2 sec) 3.8). In one embodiment, as shown in FIG. 5, six heating wire elements will be laid out at one inch apart in substantially concentric rectangles, and will be starting from the outer edge of the curtains. Eight inches of space will contain all (six) of the 8 watts heating wire elements going around the curtains. An ON/Off switch will work off the thermostat box; which can be adjusted from 1-10 for the heating levels of heating temperature coming from the heating wire elements. The switch will be able to be turned off past the point of zero, and the switch will be located on the (outer) left hand side of the thermostat box area. The thermoelectric effect will work with (six heating electrical elements) connecting squally around to the electrical box. The left side of power source will carry the positive charge from the voltage wiring and the right side will be the negative connection from the voltage element wiring. The current will stay in balance once it is defined (approximately). The AC/DC will work off an inverter fuse once the electrical power is interrupted. The Battery size can be adjusted for more later, but the present embodiment shows a 7.4 V-760 mah of capacity. The means of power will be from an electrical cord connection to the home electrical outlet or made to be connected directly to the home electrical power source. Both ways will be able to plug into the inventive electrical heating window curtain hard wire plug.

I claim:

1. An electrically heated window curtain of fire resistant material having an interior side adapted to face a room, an exterior side adapted to face a window, a top, a bottom, a right side and a left side, wherein an 8 inch perimeter of the heated window curtain is adapted to overhang beyond a frame of the window and said perimeter is covered with an aluminum foil insulated fabric on the exterior side, with a plurality of 1/16 inch diameter low voltage heating elements, individually and exclusively mounted about the perimeter of the heated window curtain on the aluminum foil insulated fabric of the exterior side of the fire resistant material and spaced 1 inch apart in substantially concentric rectangles, the electrically heated window curtain further comprising a power source, a thermostat, a battery pack, a charger, a curtain rod having a right end and a left end, with the top of the window curtain affixed to the curtain rod, a power supply box integral with the curtain rod to receive the thermostat, wherein the power source is a 120V power source and the electrically heated window curtain consumes 8 watts at 0.0666 amps when connected to the power source.

2. The electrically heated window curtain of claim 1, further comprising:

at least one quick disconnect connector associated with the heating elements to connect a heating lead to the battery pack, wherein the electrically heated window curtain consumes 8 watts at 0.66 amps when connected to the battery pack.

3. The electrically heated window curtain of claim 1, wherein the thermostat is a temperature sensor arranged to sense the ambient temperature proximate the window and selectively activate at least one of the plurality of heating elements when the ambient temperature is below 60 degrees Fahrenheit, and selectively deactivate at least one of the plurality of heating elements when the ambient temperature is above 72 degrees Fahrenheit.

4. The electrically heated window curtain of claim 1, wherein the plurality of heating elements mounted on the perimeter of the heated window curtain on the aluminum foil insulated fabric of the exterior side of the fire resistant material are arranged to warm ambient air entering the room through the window.

5. The electrically heated window curtain of claim 2, further comprising an inverter fuse, wherein the battery pack and charger work in an AC/DC mode once the inverter fuse is in use.

* * * * *